US007997436B2

(12) United States Patent
Bolli

(10) Patent No.: US 7,997,436 B2
(45) Date of Patent: Aug. 16, 2011

(54) RECLOSABLE POURING ELEMENT FOR LIQUID FOODSTUFFS CONTAINED IN COMPOSITE CARDBOARD/PLASTIC PACKAGING

(75) Inventor: Felix Bolli, Beringen (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 659 days.

(21) Appl. No.: 11/915,961

(22) PCT Filed: Mar. 29, 2007

(86) PCT No.: PCT/EP2007/053047

§ 371 (c)(1),
(2), (4) Date: Nov. 29, 2007

(87) PCT Pub. No.: WO2007/113216

PCT Pub. Date: Oct. 11, 2007

(65) Prior Publication Data

US 2008/0185384 A1 Aug. 7, 2008

(30) Foreign Application Priority Data

Mar. 31, 2006 (DE) ..... 10 2006 015 524

(51) Int. Cl.
*B65D 17/42* (2006.01)
*B65D 39/00* (2006.01)

(52) U.S. Cl. ..... 220/277; 215/297

(58) Field of Classification Search ..... 229/249, 229/248, 247; 220/200; 215/316, 200; 222/80, 222/541.1, 568, 567, 566, 552, 549, 548, 222/544

See application file for complete search history.

(56) References Cited

U.S. PATENT DOCUMENTS

| | | | | |
|---|---|---|---|---|
| 2,124,638 | A * | 7/1938 | Sheldon et al. | 215/252 |
| 4,469,249 | A * | 9/1984 | Malpas et al. | 222/83 |
| 4,483,464 | A * | 11/1984 | Nomura | 222/83 |
| 5,020,690 | A * | 6/1991 | Kishikawa et al. | 222/83 |
| 5,147,070 | A * | 9/1992 | Iwamoto | 222/83 |
| 5,366,114 | A * | 11/1994 | Bernstein et al. | 222/83 |
| 5,482,176 | A * | 1/1996 | Maietta et al. | 220/277 |
| 6,382,462 | B1 * | 5/2002 | Ostergaard-Nielsen et al. | 222/1 |
| 2002/0179605 | A1 * | 12/2002 | Miani et al. | 220/277 |
| 2005/0236425 | A1 * | 10/2005 | Casale et al. | 222/83.5 |

FOREIGN PATENT DOCUMENTS

| | | | |
|---|---|---|---|
| DE | 102004040928 | A1 | 3/2006 |
| EP | 1262412 | A1 | 4/2002 |
| EP | 1415926 | A1 | 5/2004 |
| EP | 1591367 | A1 | 2/2005 |
| WO | 2004/000667 | A1 | 12/2003 |

* cited by examiner

*Primary Examiner* — Anthony Stashick
*Assistant Examiner* — Robert J Hicks
(74) *Attorney, Agent, or Firm* — The Webb Law Firm

(57) ABSTRACT

A re-closable pouring element for liquid foods packaged in cardboard/plastic composite packages, comprising a base encircled by a flange and having both an inner thread and an outer thread, an opening element having at least one cutting edge as well as perforations and a screw cap formed as a threaded lid. The opening element has an outer thread and is arranged inside the base. The opening element is formed so that when the screw cap is operated for the first time it cuts an opening in the package material located under the pouring element. At least one window opening is provided as an aperture, each window opening is arranged so that it points to one side after opening for the first time and after re-closing and repeated opening for emptying residues of the composite package points to the opposite side.

16 Claims, 7 Drawing Sheets

RECLOSABLE POURING ELEMENT FOR LIQUID FOODSTUFFS CONTAINED IN COMPOSITE CARDBOARD/PLASTIC PACKAGING

BACKGROUND OF THE INVENTION

1. Field of the Invention

The invention relates to a re-closable pouring element for liquid food, packaged in cardboard/plastic composite packages including a base, encircled by a flange and having both an inner thread and an outer thread, an opening element having at least one cutting edge or the like as well as perforations and a screw cap implemented as a threaded lid, wherein the opening element has an outer thread and is arranged inside the base and wherein the opening element is formed so that when the screw cap is used for the first time, it cuts an opening in the material of the package located under the pouring element.

2. Description of Related Art

Re-closable pouring elements for liquid food packaged in cardboard/plastic composite packages of various configurations are known in practice. On the one hand they serve for first-time opening of the packages and in the configuration of interest here are fitted from the outside onto the already filled and closed package. Frequently for this purpose the package material in the region of the (later) opening for pouring has a weakened zone. This can be formed either as a perforation in the material or however as an opening for pouring in the substrate (Cardboard) which, when the inner and outer plastic layers are laminated, is covered over with plastic, usually polyethylene (EP 1 591 367 A1).

In each case it is necessary, when opening for the first time, that a cutting force applied by the user is translated into an opening operation, so that reliable opening of a sufficiently large opening for pouring is ensured. Besides pouring elements with swivelling opening elements, such pouring elements, which are provided with a screw cap as lid and wherein twisting off the screw cap for the first time causes corresponding turning of a ring-shaped opening element into the package material, have in particular proven satisfactory.

A pouring element of this kind is disclosed in EP 1 262 412 A1. It consists of a base, encircled by a mounting flange, having a hollow-cylindrical opening element arranged therein and a screw cap, the three individual parts being coordinated with one another, so that when the pouring element is opened for the first time, a helical movement of the opening element and thus creation of an opening for pouring results by means of positive connection between screw cap and opening element.

The known pouring element has perforations distributed over the circumference of the opening element, which perforations are to provide better aeration, in order to permit "gulp-free" pouring. In order to achieve this, they must, in the case of the swivelled (with the package) pouring element, if possible be arranged above the level of the product. This arrangement however makes it difficult to completely empty the contents of the package. The known pouring element must therefore always be fitted in a pre-determined direction onto the respective type of package.

Another pouring element is known from DE 10 2004 040 928 A1. Here a window opening is provided as an aperture, which is arranged for pouring out so that it is brought into line with an opening in the cutting tube, after this has cut open the package material.

Another known pouring element (EP 1 262 412 A1) has openings in the opening tube which, when pouring out, serve to allow air to enter the package. Although these will also be able to improve emptying of the residues, after first-time opening they remain, together with the opening tube, in the opened position.

Finally yet another three-part pouring element is known from WO 2004/000667, wherein however the opening element is not moved by screwing. The actual opening operation consists in a combination of a piercing and a rotating motion, thus superimposition of an axial and a radial movement. Because this known opening element does not do away with apertures, this is also not optimized in respect of the emptying of residues.

However it is dependent on the size whether the packages are emptied all at once by the consumer, or however, due to their size, are re-closed again or several times before being thrown away. Thus on the one hand small package sizes, for example units for school children, sportsmen or for consumption in the car having contents of 0.2 or 0.25 litres as so-called "single-serve" applications, are usually emptied in one go. On the other hand packages of 1 or 1.5 litres or even larger units are usually re-closed after opening for the first time in order to protect the product from loss of aroma, absorption of extraneous odours etc. Here however the known pouring elements are not universal enough.

SUMMARY OF THE INVENTION

The object of the invention therefore is to configure and refine the pouring element mentioned at the outset and previously described in detail, so that it is able to ensure optimum emptying of residues for every pack size.

This object is achieved with a pouring element having all the features of one embodiment of the present invention. The emptying of residues is achieved by the fact that, due to the positive connection between screw cap and opening element, when opened for the first time, the opening element is moved into a first position and with repeated opening is turned into the opposite position.

Whenever a 'window opening' is mentioned in the following, all geometrically conceivable shapes of window openings are to be understood; in particular even such embodiments where the window opening is not completely surrounded by a frame, thus for example also a recess at the lower edge of the opening element.

In accordance with a preferred teaching of the invention the window opening has a substantially rectangular shape. Thus fast and reliable emptying of residues is ensured.

A further embodiment of the invention provides that the outer thread of the opening element has two intermeshing threads. This embodiment permits the threads to be configured relatively steeply, so that a sufficiently large force can be applied to the cutting edge of the opening element when cutting into the package material for the first time. Particularly preferably each thread embraces the opening element by at least 540° (1½ times), so that the opening element can be rotated more than 360° when the cap is first screwed on.

In a further embodiment of the invention, it is proposed that the outer thread of the opening element is reduced or interrupted in the lower section at least in one region and that the inner thread of the base is reduced or interrupted at least in a corresponding region. As a result it is possible to carry out assembly of opening element and base without pressing in or over-compressing the threads. As a result of the corresponding reductions or interruptions it is no longer necessary to screw the opening element into the base during initial assembly. Due to the bayonet-type engagement of the thread, when the screw cap is operated for the first time the opening element is turned and, already after turning a short way, the positive connection of the threads coordinated with one another results in helical penetration of the cutting edge of the opening element into the package material and therefore alignment of the window opening into the "single-serve" position.

In accordance with a further teaching of the invention it is provided that the outer thread of the opening element is reduced or interrupted at two opposite regions. In this way very good torque distribution is possible, since the opening element is reliably guided inside the base. Advantageously the base also has two diametrically opposed threaded sections in its interior.

According to another teaching of the invention the outer thread of the opening element in each case is reduced or interrupted in the lower thread. In this way it is achieved that already after turning the screw cap and therefore the opening element just a short way, engagement in four different places of the threads occurs, so that the necessary piercing and cutting force can be applied.

Moreover a further arrangement of the invention provides that the at least one cutting edge is suitable both for piercing the cardboard/plastic composite material and for cutting out an opening for pouring. The cutting edge is preferably formed so that when turning into the package material, the cut length for forming the opening for pouring is less than a complete circle.

As the result of a cutting edge formed accordingly, the torn out piece of composite package is not entirely detached from the remaining composite material, but is swivelled laterally inwards and fixed there by the opening element projecting in the manner of a tube into the package interior, so that the entire clear cross section of the opening element is available as an opening for pouring. It can be realised either by an axial length of the cutting edge, which is smaller than the axial length of a thread or however by a cutting edge correspondingly bent inwards, so that the radius of the torn out piece of composite material is not the same size, but slowly becomes larger.

According to another embodiment of the invention the base has a plurality of threaded sections in the interior, in each case diametrically opposed. The arrangement of these threaded sections is selected so that when the opening element is axially inserted, the reduced or interrupted regions of the threads of the opening element can be moved past the threaded sections arranged inside the base. The outer thread of the opening element and the inner thread of the base only intermesh through rotating the opening element by manipulating the screw cap.

A further teaching of the invention provides that at least one limit stop is provided in the lower region of the base for the opening element which is unscrewed downwards. Alternatively the or each outer thread of the opening element can also have at least one limit stop. These limit stops reliably ensure that the opening element cannot enter the package interior.

A plurality of protrusions, which have a hook-shaped cross section and are distributed inside the opening element, serve to move the opening element in the base. Accordingly the screw cap is formed so that at least one driving bar is provided in its interior, which bar extends bent concentrically downwards running from the top side of the cap and in this way interacts in a ratchet-like manner with the projections inside the opening element. As a result it is achieved that the opening element in each case is only turned when the cap is unscrewed, thus in a counter-clockwise direction. Renewed screwing of the cap causes the at least one driving bar to slide off inwards, so that the opening element remains in its respective position.

Finally it is proposed according to another teaching of the invention that the screw cap is connected to the base in the fitted position by means of material bridges serving as predetermined breaking points. In this case the material bridges preferably run between the cap and a mounting plate, which is connected to the flange of the base.

The invention is described below in detail on the basis of a drawing illustrating a single preferred embodiment.

DETAILED DESCRIPTION OF THE INVENTION

Figure 1:
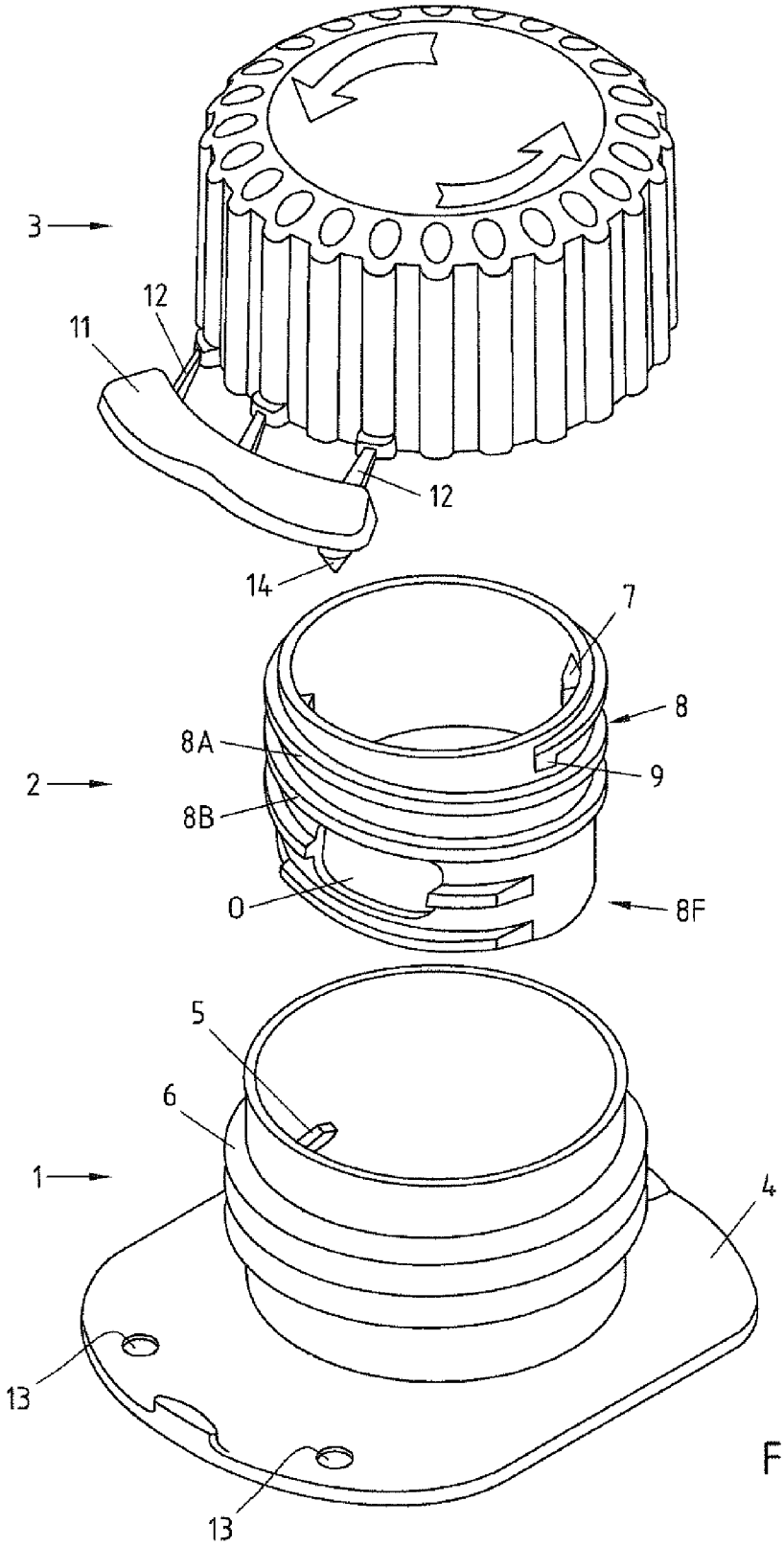
FIG. 1 an embodiment of the pouring element according to the invention before its assembly shown in perspective, FIG. 2 the finished fitted pouring element shown in perspective, FIG. 3 the pouring element after first-time opening of the screw cap shown in perspective, FIG. 4 the subject matter of FIG. 3 in perspective view from diagonally below, FIG. 5 the pouring element after repeated opening in perspective view from diagonally below, FIG. 6 base and opening element in the fitted position, cut open in perspective view from below, FIG. 7 the subject matter of FIG. 6 after repeated opening, cut open in perspective view and FIGS. 8 and 9 the pouring element according to the invention, in each case fitted onto a small-sized "single-serve" package and a large-sized so-called "multi-serve" package.

In FIG. 1 the pouring element according to the invention is illustrated as an exploded view. It essentially includes three different parts, that is to say a base 1, a hollow-cylindrical opening element 2 and a screw cap 3. The base 1 is encircled by a flange 4 and has an inner thread 5, which is described in greater detail later.

The opening element 2 has a clearly visible window opening o according to the invention on one side as well as in its interior two diametrically opposed hook-like projections 7, via which the turning torque necessary for opening is transferred from the screw cap 3 to the opening element 2. On its outside lateral surface the opening element 2 is provided with an external thread 8, which will also be discussed in greater detail.

In the illustrated and to this extent preferred embodiment the outer thread is reduced in the lower section, as can be clearly seen in FIG. 1. The reduced zones of the outer thread 8 are preferably at two diametrically opposed regions 8F of the opening element 2.

A limit stop 9, which ensures that the opening element 2 screwed into the package interior cannot fall out of the base 1 and enter the package interior is arranged in each case at the upper end of the outer thread 8, which in the preferred embodiment consists of intermeshing threads 8A and 8B in each case offset by 180°.

Figure 4:
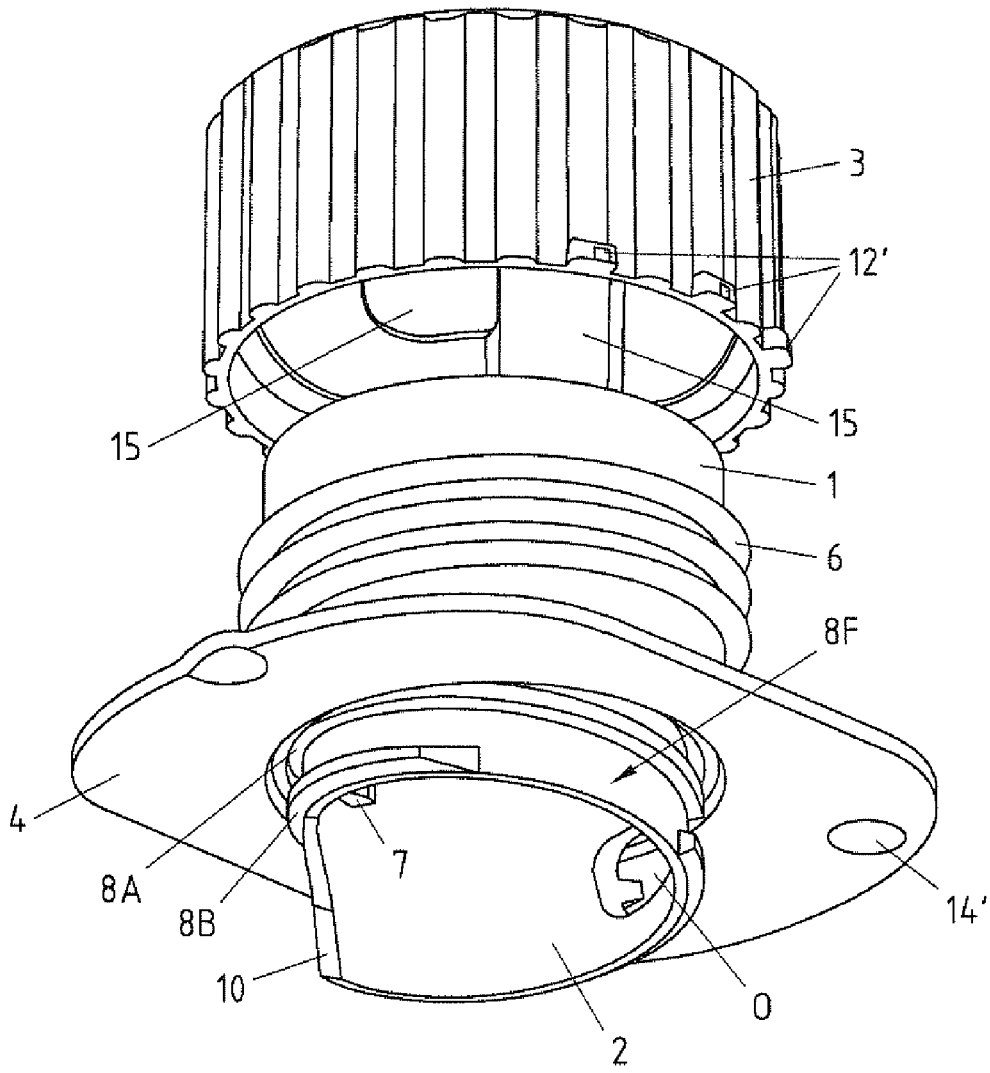

Furthermore the opening element 2 has at its lower end a cutting edge 10, as can be seen particularly clearly in FIG. 4.

Figure 2:
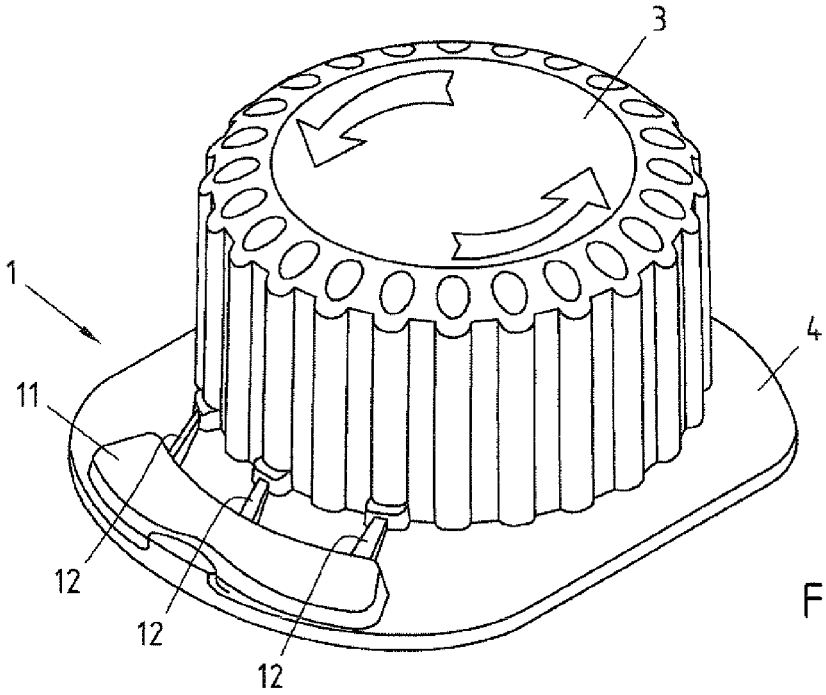

In FIG. 2 the pouring element according to the invention is shown in perspective in the ready fitted position. It is clearly recognizable that the screw cap 3 is integrally connected to a mounting plate 11, which is in positive or non-positive communication with the base 1.

Figure 3:
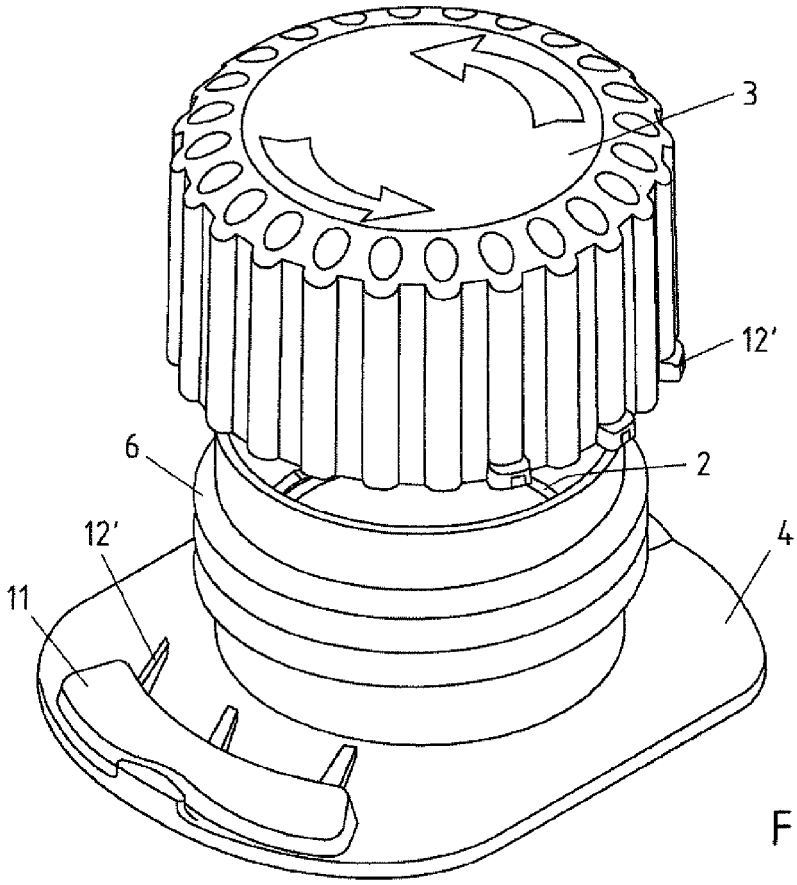
Figure 5:
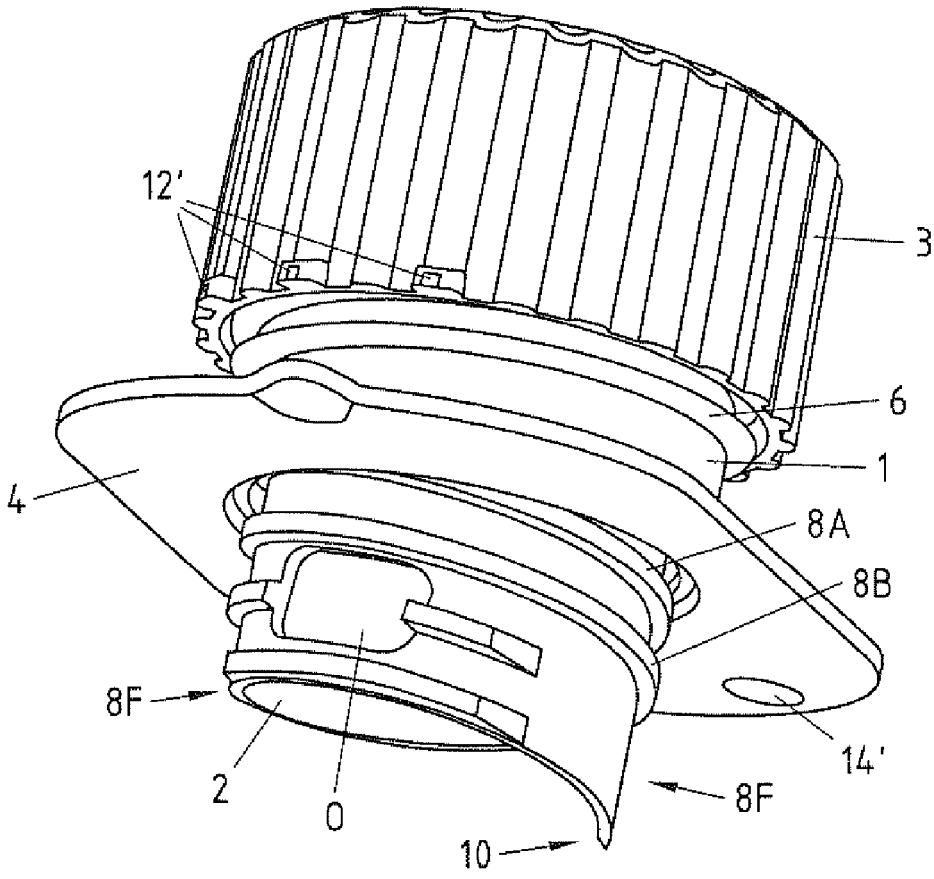

FIG. 3 shows the pouring element in the same perspective view after screw cap 3 has been unscrewed for the first time. Predetermined breaking points in the material bridges 12, connecting the mounting plate 11 and the screw cap 3, tear during opening; in the illustrated and to this extent preferred embodiment the pouring element has three such material bridges 12, the destroyed material bridges 12' being recognizable in FIGS. 3 to 5.

The mounting plate 11 is preferably positively connected to the flange 4 of the base 1. To this end two openings 13 extending downwards are provided in the flange 4, in which openings two connecting spigots 14 (see FIG. 1), running downwards from the mounting plate 11, engage and are caulked there, as indicated in FIG. 4 by 14'. Here—after the first opening—the window opening 0 points to the mounting plate 11 (not shown).

From FIG. 4 it is also evident that the screw cap 3 is provided in its interior with two concentric driving bars 15, which project downwards from the lid of the screw cap 3 and through their curved concentric bar shape can transfer turning torques in a torsionally rigid way, but may deviate radially inwards. As a result of this arrangement in conjunction with the hook-shaped arrangement of the projections 7 inside the opening element 2, it is achieved that when opened for the first time, the opening element 2 with its cutting edge 10 cuts an opening in the package material located below the pouring element. However when the screw cap 3 is closed the driving bars 15 are diverted inwards by the corresponding bevels of the projections 7, so that the opening element 2 is not rotated.

With repeated opening however the driving bars 15 as a result of their length again engage behind the hook-like projections 7 and cause the opening element 2 to be screwed still slightly further into the package material. This position can be clearly seen in FIG. 5, wherein the opening element 2 has once again completed an approximately 180° turn. It is clearly evident that the window opening ○ now points away from the (not shown) mounting plate 11 ("multi-serve" position).

Figure 6:
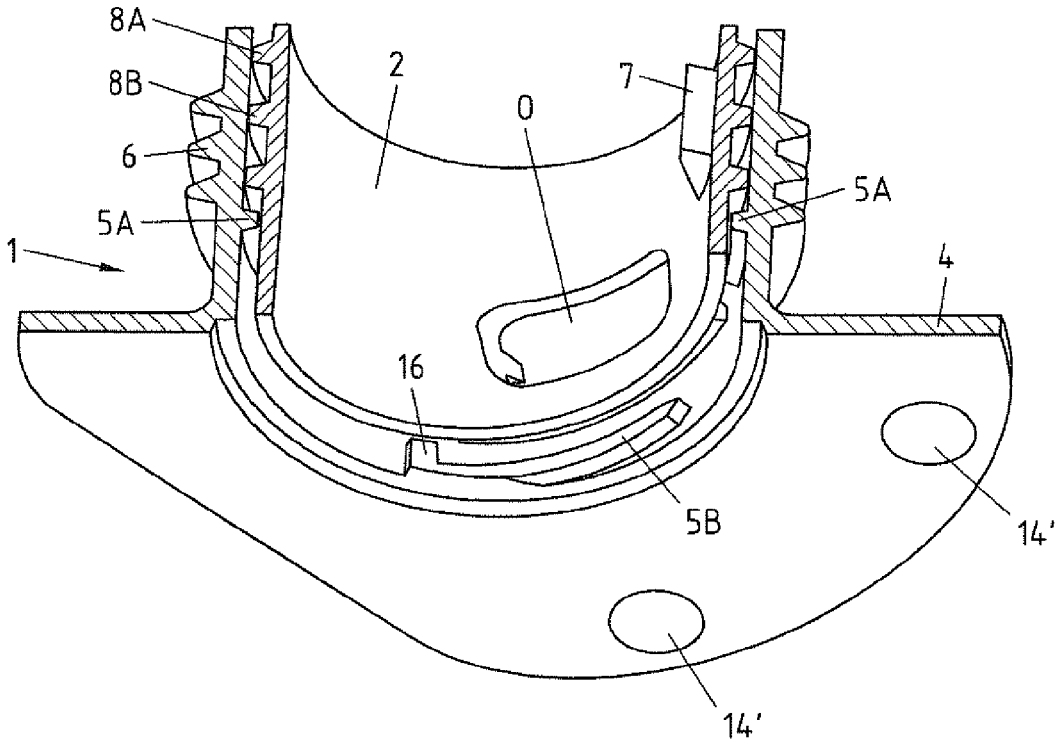
Figure 7:
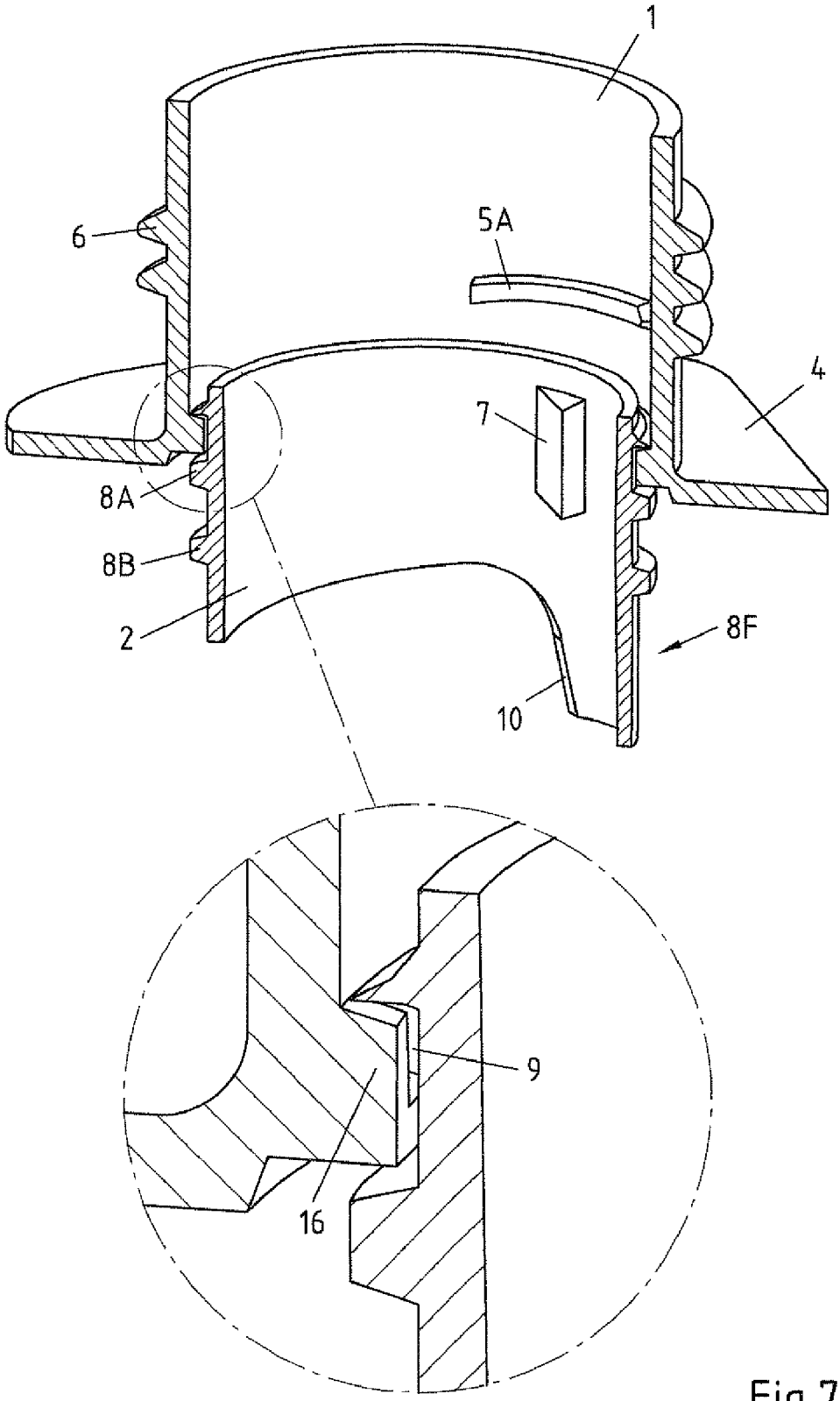

In FIGS. 6 and 7 the functional mode of opening is now explained in detail with sectional views. In FIG. 6 it can be seen that also the base 1 in its interior at the end of the lower thread section 5B likewise has a limit stop 16, which cooperates with the limit stops 9 of the opening element, as can be seen in FIG. 7. In this way it is reliably ensured that the opening element 2 operated by the screw cap cannot become detached from the pouring element and fall into the package interior. On the contrary it remains in the end position, wherein the piece of composite material formed by the cutting edge 10 but not entirely detached, is bent perpendicularly downwards, so that the complete clear cross section of the opening element 2 is available for pouring out.

Figure 8:
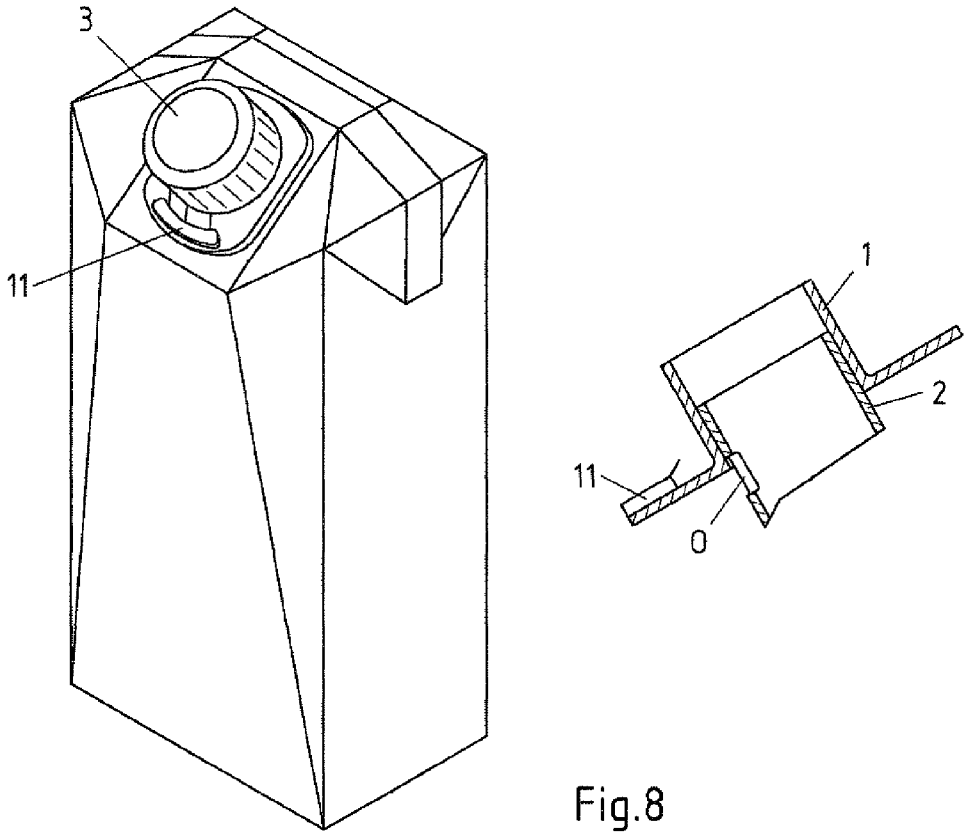

Finally FIGS. 8 and 9 again show the preferred applications for the pouring element according to the invention:

In FIG. 8 the pouring element with mounting plate 11 aligned downwards is fitted onto a ("single-serve") small-sized package (not described in detail). Here the window opening o points to the mounting plate 11 attached below the pouring spout, therefore pointing downwards.

Figure 9:
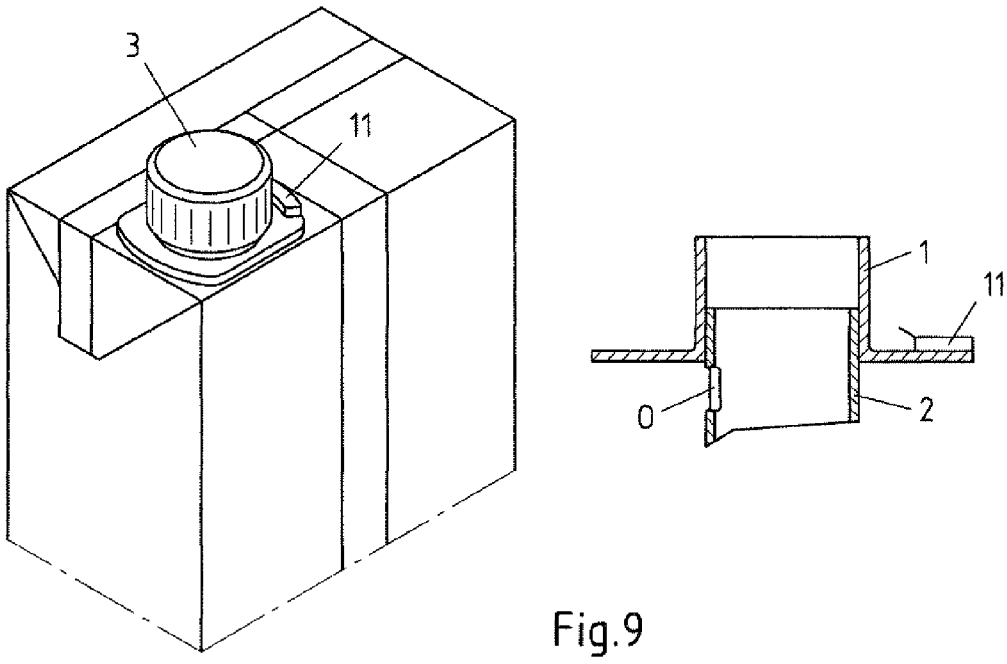

On the other hand in FIG. 9 the pouring element with mounting plate 11 aligned to the rear is arranged on a ("multi-serve") large-sized package (not described in detail), in order to bring the opening of the base 1 as near as possible to the package edge. After the second opening operation the window opening o points away from the mounting plate 11 attached below the pouring spout and during the pouring out again points downwards as required towards the "pouring edge", in order to ensure optimum emptying of residues.

The invention claimed is:

1. A re-closable pouring element for liquid food packaged in cardboard/plastic composite packages, comprising:

a base encircled by a flange and having both an inner thread and an outer thread;

an opening element having at least one cutting edge as well as perforations; and a screw cap formed as a threaded lid, wherein the opening element has an outer thread and is arranged inside the base and wherein the opening element is formed so that when the cap is operated for the first time the opening element cuts an opening in package material located under the pouring element, wherein the opening element has at least one window opening, the at least one window opening being arranged so that after opening for the first time the at least one window opening points to one side and after re-closing and repeated opening for emptying residues of the composite package points to the opposite side.

2. The pouring element according to claim 1, wherein the window opening has a substantially rectangular shape.

3. The pouring element according to claim 1, wherein the outer thread of the opening element has two intermeshing threads.

4. The pouring element according to claim 3, wherein each intermeshing thread embraces the opening element by at least 540°.

5. The pouring element according to claim 1, wherein the outer thread of the opening element is reduced or interrupted in a lower section of the outer thread at least in one region and wherein the inner thread of the base is reduced or interrupted at least in a corresponding region.

6. The pouring element according to claim 5, wherein the outer thread of the opening element is reduced or interrupted at two diametrically opposed regions.

7. The pouring element according to claim 3, wherein the outer thread of the opening element is reduced or interrupted in each case in a lower section of the outer thread.

8. The pouring element according to claim 1, wherein each outer thread of the opening element at its upper end has at least one limit stop.

9. The pouring element according to claim 1, wherein the at least one cutting edge is suitable both for piercing the package material and for cutting out an opening for pouring.

10. The pouring element according to claim 9, wherein the cutting edge is formed so that when turning into the package material, a cut length for forming the opening for pouring is less than a complete circle.

11. The pouring element according to claim 1, wherein the base has a plurality of diametrically opposed, threaded sections in an interior of the base.

12. The pouring element according to claim 1, wherein at least one limit stop is provided in a lower region of the base for the opening element which is unscrewed downwards.

13. The pouring element according to claim 1, wherein the opening element has a plurality of projections distributed over its interior.

14. The pouring element according to claim 13, wherein the screw cap has in its interior at least one driving bar, which extends from the top side of the screw cap bends concentrically downwards and interacts with the projections in a manner of a ratchet.

15. The pouring element according to claim 1, wherein the screw cap in a fitted position is connected to the base by material bridges serving as predetermined breaking points.

16. The pouring element according to claim 15, wherein the material bridges run between the screw cap and a mounting plate, and wherein the mounting plate is connected to the flange of the base.

* * * * *